US007497637B2

(12) United States Patent
Brandstein

(10) Patent No.: US 7,497,637 B2
(45) Date of Patent: Mar. 3, 2009

(54) MICROPRINT PEN

(76) Inventor: Aaron S. Brandstein, 2410 Barker Ave., Apt. 9A, Bronx, NY (US) 10467

( * ) Notice: Subject to any disclaimer, the term of this patent is extended or adjusted under 35 U.S.C. 154(b) by 456 days.

(21) Appl. No.: 11/062,191

(22) Filed: Feb. 18, 2005

(65) Prior Publication Data

US 2005/0186017 A1 Aug. 25, 2005

(51) Int. Cl.
*B43K 7/10* (2006.01)

(52) U.S. Cl. ..... 401/215

(58) Field of Classification Search ..... 401/208, 401/209, 213, 215
See application file for complete search history.

(56) References Cited

U.S. PATENT DOCUMENTS 3,376,551 A * 4/1968 Armbruster ..... 382/188
4,211,012 A * 7/1980 Alles et al. ..... 33/18.1
4,703,511 A * 10/1987 Conoval ..... 382/182
6,715,687 B2 * 4/2004 Berson ..... 235/487
7,197,174 B1 * 3/2007 Koizumi ..... 382/139

* cited by examiner

*Primary Examiner*—Huyen Le
(74) *Attorney, Agent, or Firm*—Lackenbach Siegel LLP; Myron Greenspan

(57) ABSTRACT

A covert-print marking apparatus creates a unique marking system and method of using a casing or housing with a working-end and a non-working-end, a source or ink or other marking substance situated in the casing and a point having a covert-printing element on a outer surface of the casing. Thus the covert-printing element deposits a covert-printed line or mark with an embedded code formed by the element. The point bearing the covert-printing element is located at the working end of the casing. The marking element is a movable member that is able to rotate when moved along a surface, and the point is in fluid flow communication with the source of ink or other marking substance, chemical or element.

16 Claims, 6 Drawing Sheets

MICROPRINT PEN

BACKGROUND OF THE INVENTION

1. Field of the Invention

The present invention relates generally to writing or marking apparatus and more specifically to writing instruments and other apparatus for creating unique markings, or covert prints within an ink line marked with ink, or other marking substances, thereby providing means for verification of document authorship, origin and/or content authenticity.

2. Description of the Related Art

It can be appreciated that writing or marking apparatus and other instruments for marking substrates such as pens have been in use for centuries. Specifically, pens are used to write and/or sign documents such as contracts, currency, bonds, stocks, securities, travelers checks, bank checks, credit cards, credit cards receipts, passports, airline tickets, labels, green cards, prescription slips, tests and examinations, police or witness reports, affidavits, research documents, legal waivers and releases, and any other business, personal, legal and/or government documents in which identification of the creator or signatory is critical. Writing instruments may also be used in many unofficial applications, including but not limited to personal correspondence, journaling for posterity, archiving and scrap-booking, writing for publication, autographing, or a variety of other unofficial purposes.

Writing instruments known in the art are limited in that they do not provide means for identifying writing or their marks as unique to a particular writing instrument for the purposes of security or verification of authorship, origin and/or content authenticity. Reliance on writing analysis has been one of the sole bases for establishing authenticity. Thus, conventional writing instruments do not offer security features, and it is possible to forge or otherwise deceitfully obscure the origin, authorship and/or content authenticity of writings by simply mimicking the signature or writing of another individual or mechanism.

While conventional writing instruments and marking apparatus such as pens are suitable for writing and creating a mark, they often fail to provide means of verification of document authorship, origin and/or content authenticity on solely the basis of the instrument used. The marking apparatus of the present invention, including the writing instruments presented herein, substantially improve upon the designs of the prior art by providing a writing instrument and marking apparatus that create a unique marking or covert print within a printed or written ink line or marking, thereby providing means of verification of document authorship, origin and/or content authenticity.

SUMMARY OF THE INVENTION

In view of the foregoing disadvantages inherent in writing instruments of the prior art, the present invention provides a new covert-print writing apparatus construction wherein the same can be utilized for creating unique markings, or covert prints, within the written or printed ink line(s) to provide means of verification of document authorship, origin and/or content authenticity of all lines or markings created by the writing apparatus, including all content in addition to the signature, if present.

The general purpose of the present invention, which will be described subsequently in greater detail, is to provide a marking apparatus resulting in a new covert-print writing or marking apparatus with an inherent security function which is not anticipated, rendered obvious, suggested, or even implied by any of the prior art writing or marking instruments, either alone or in any combination thereof.

A primary object of the present invention is to provide a covert-print apparatus that will overcome the shortcomings of the prior art devices.

Another object of the present invention is to provide a writing apparatus for creating unique covert-print markings within the written ink line(s) or mark(s) to provide means of verification of document authorship, origin and/or content authenticity, including all content in addition to the signature.

Still another object is to provide a covert-print apparatus that provides a unique result that is unobtrusive and does not limit or interfere with normal use of the writing apparatus.

Yet another object is to provide a covert-print apparatus that provides a unique result that may not be noticed without the benefit or use of a reading device.

It is a further object to provide a covert-print apparatus that provides a unique result without any special effort or training of the creator or writer.

It is still a further object to provide a covert-print apparatus that provides a unique result that may not be copied or reproduced by conventional means.

It is yet a further object to provide a covert-print apparatus that may be utilized for various levels of security and in multiple circumstances.

It is an additional object to provide the option of a self-contained verification system in the form of an included magnifying device in the covert-print apparatus to enable examination of covert prints within the written line(s) and check code authenticity and/or clarity.

These objects are achieved by a writing or marking instrument for creating a unique marking having a casing, having a working end and a non-working end; an ink source situated in said casing; and a point having covert-printing means disposed on an outer surface thereof for depositing a line or character or mark having a covert-print embedded code formed by said covert-printing means, said point being disposed at the working end of the casing, said point being a movable member arranged to rotate when moved along a surface, and said point being in fluid flow communication with said ink source.

The objects are additionally achieved by a method of making a covert-printed line comprising the steps of: employing a marking apparatus comprising a casing having a working end and a non-working end; an ink source situated in the casing; and a point disposed at the working end of the casing and mounted for rotation when moved along a surface, said point having covert-printing means disposed thereon, wherein said point communicates with said ink source and a writing surface; moving said point of said marking apparatus across said writing surface such that said point rotates along said surface; and depositing a written line on said writing surface that incorporates covert-print embedded code formed by said covert-printing means.

The objects are further achieved by a method for authenticating a written ink line or mark as being unique to a particular marking apparatus, the method requiring the steps of assigning a writing instrument comprising a casing having a working end and a non-working end; an ink source situated in casing; and a point disposed at the working end of the casing, said point having a unique covert-printing means disposed thereon to a specific creator; having said creator employ said writing instrument for applying a coded marking on a surface such as by writing, thereby creating a writing having a covert-printed code formed therein; inspecting said writing for said covert-printed code formed on the surface; and ensuring that said covert-printed code formed by said code of the covert-printing means matches said covert-printing means of said assigned writing instrument.

Other objects and advantages of the present invention will become obvious to the reader and it is intended that these objects and advantages are within the scope of the present invention.

BRIEF DESCRIPTION OF THE DRAWINGS

Various other objects, features and attendant advantages of the present invention will become fully appreciated as the same becomes better understood when considered in conjunction with the accompanying graphics, in which like reference characters designate the same or similar parts throughout the graphic, and wherein.

DETAILED DESCRIPTION OF THE INVENTION

Figure 1:
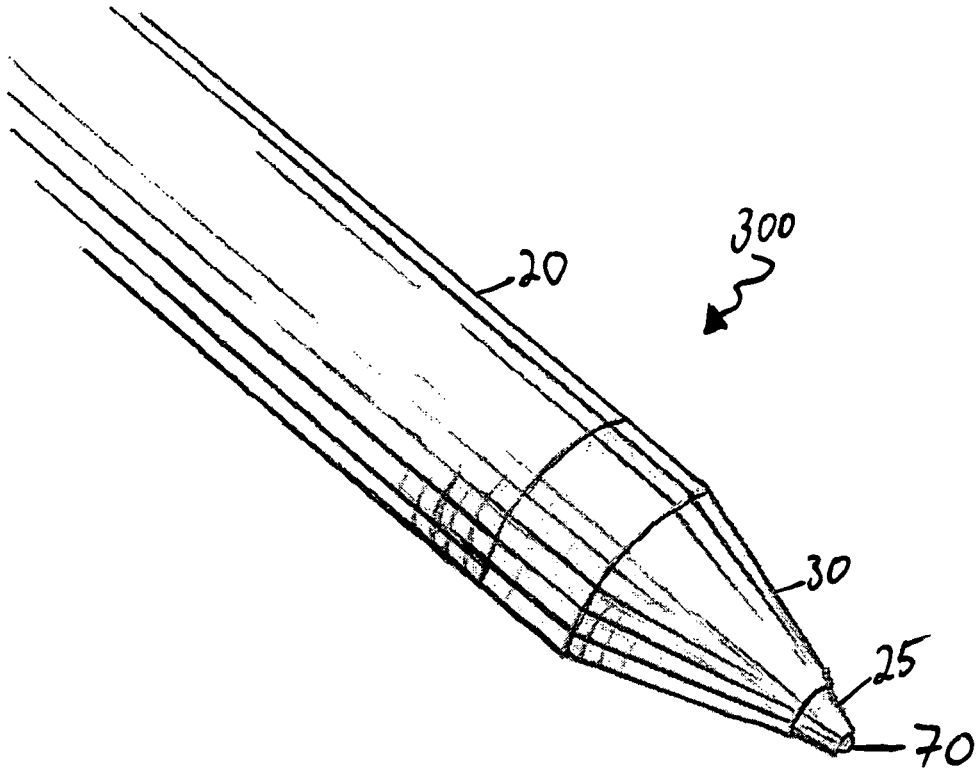
FIG. 1 is a perspective view of a first embodiment of the covert-print apparatus of the present invention.

A covert-print apparatus 300 is illustrated in FIGS. 1 to 12, in which similar reference characters denote similar elements throughout. For purposes of this application and a description of the invention herein, "covert-print" means any coded markings, in the form of lines or other characters from which embedded codes are not visible and may not be noticed without the benefit or use of a reading device.

Figure 2:
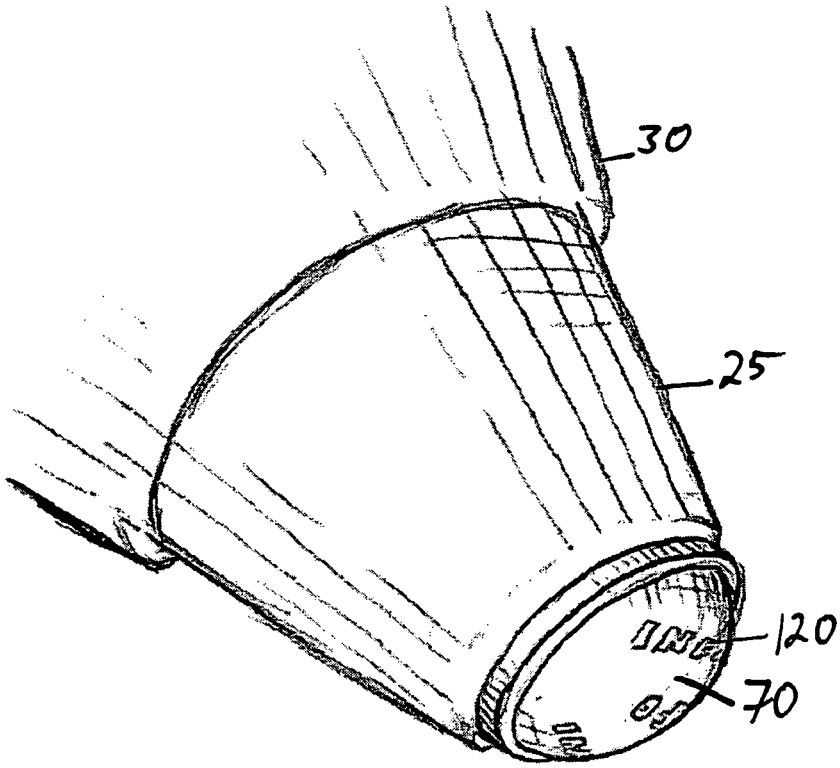
FIG. 2 is a magnified perspective view of the tip of the covert-print apparatus shown in FIG. 1.
Figure 3:
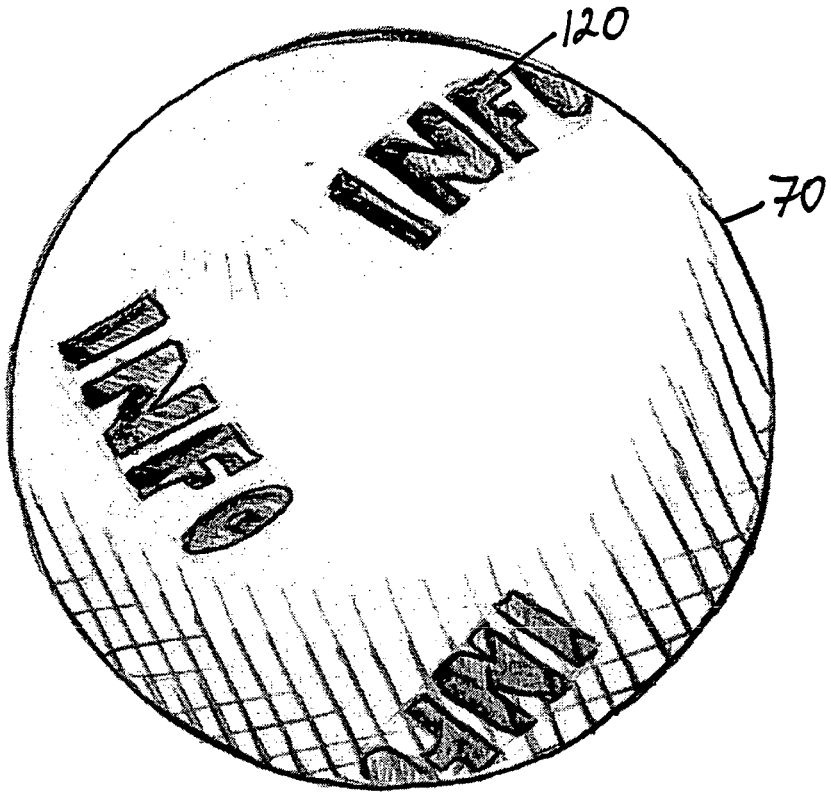
FIG. 3 is a magnified view of the point of the covert-print apparatus shown in FIG. 1.
Figure 9:
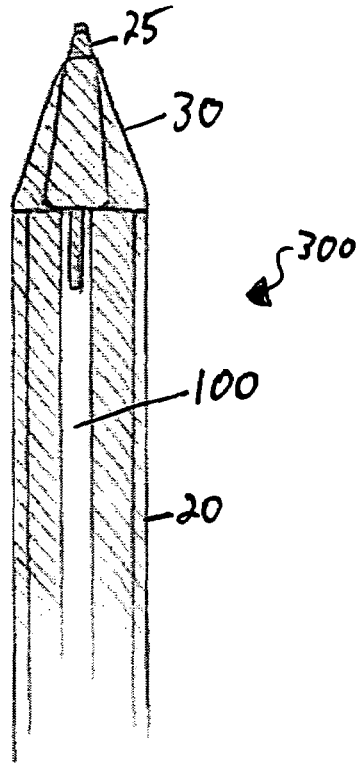
FIG. 9 is a cross-sectioned side view of the ink reservoir of the covert-print apparatus of the present invention shown in FIG. 1.
Figure 10:
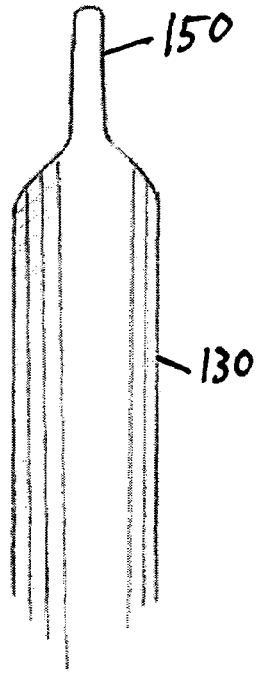
FIG. 10 is a side view of the magnifying cap for any embodiment of the covert-print apparatus of the present invention.
Figure 11:
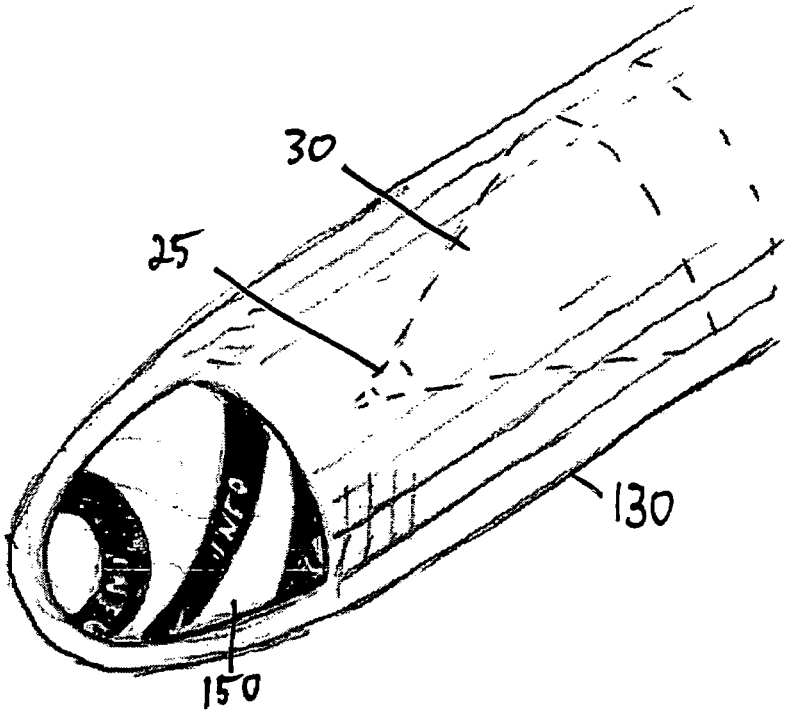
FIG. 11 is a side perspective view illustrating the cap of the covert-print apparatus of the present invention illustrating the microprint feature within the written ink line or mark magnified using the magnification feature of the cap.

Covert-print apparatus 300, as illustrated in FIG. 1, has a casing 20, a tip 30, a stem 25, and a point 70. As illustrated in FIG. 2, point 70 is housed within stem 25. Stem 25 is housed within tip 30. Stem 25 regulates the ink flow between the reservoir and the point. Casing 20 preferably has a reservoir or source of ink 100, as illustrated in FIG. 9. Tip 30 is removably coupled by any suitable means to the working end casing 20. Point 70 allows appropriate access to ink reservoir or source 100 through stem 25. As shown in FIG. 3, point 70 is preferably spherical, having unique covert-print features 120 that are permanently formed on the surface of point 70. Covert-print features 120 may be raised or recessed or both simultaneously. Point 70 is designed to deliver ink directly onto a writing surface. Casing 20, tip 30, stem 25, and point 70 may vary considerably in color, size, shape, volume, weight, density, and material. Tip 30 and/or stem 25 may also be integrally formed with ink reservoir or source 100. Covert-print apparatus 300 may further have a cap 130 for protecting tip 30, as illustrated in FIG. 11.

Referring again to FIG. 1, casing 20, is preferably thin and tubular, such that it may be easily gripped and manipulated for the purpose of creating controlled markings on a writing surface. Tip 30 is preferably conical in shape. Tip 30 houses the stem 25 that houses point 70 in such a way as to allow limited access to ink reservoir or source 100, while also allowing point 70 to protrude appropriately to make direct contact with a writing surface. Tip 30 may be coupled to casing 20 by a variety of means, including but not limited to screwing onto threads cut into the working end of casing 20, snapping into place, fitting into or onto casing 20 by means of friction or vacuum or suction pressure (whereby pressure inside the casing is significantly lower than atmospheric pressure outside the casing, allowing this acting force to hold parts of the casing together as one unit) or being fitted and secured by means of an adhesive, or otherwise fastened in such a way as to be secure for use while allowing necessary access, opening, detaching, or disassembling of components for the purposes of refilling, emptying, cleaning, or any other action needed for use or maintenance. It should be noted that tip 30 and casing 20 may comprise one integral piece, as in a disposable embodiment of the present invention.

Casing 20 has an opening for the insertion, removal, and replacement of ink reservoir or source 100. Ink reservoir 100 preferably has openings, where necessary, to allow air to enter and, thus, ink to escape. Alternatively, ink reservoir 100 may be pressurized, thereby averting the need for an opening.

Ink reservoir or source 100 (if a separate reservoir or other component is employed) is inserted into casing 20, by means of an opening located in one end of casing 20, or alternately by means of separating a first half of casing 20 from a second half of casing 20 and reattaching the halves around ink reservoir or source 100 by any of a number of secure and removable means as described above. Tip 30 is coupled to the working end of casing 20 by any of a number of secure and removable means as described above. Ink reservoir 100 may alternately be inserted and attached by screwing means, if ink reservoir 100 and tip 30 are designed as separate components and may therefore be disengaged from one another without damaging or otherwise hindering the functioning of covert-print apparatus 300. Alternatively, ink reservoir 100, casing 20, tip 30, stem 25 and point 70 in any combination may also be formed as one integral unit such that any attempt to insert ink or replace ink reservoir 100 would render covert-print apparatus 300 inoperable, thus limiting the use of that specific covert-print apparatus 300 by rationing the initial load of ink to an amount suitable for a limited number of uses.

In an alternate embodiment, ink reservoir 100 is pressurized or specially designed to preclude the need for an air hole in casing 20 to allow delivery of ink. In an additional embodiment not shown, ink may be deposited directly into an opening in casing 20. Covert-print apparatus 300 may employ additional alternate ink sources. Non-limiting examples of such ink sources include, but are not limited to a liquid reservoir, a sponge, and powdered or solid color sources. Casing 20 may also be designed to hold and dispense ink without need for a separate ink reservoir 100. Covert-print apparatus 300 may additionally be designed to allow the insertion, attachment, or use of tip 30, or wherein tip 30 and stem 25 is inextricably a part of ink reservoir or source 100.

Covert-print apparatus 300 may have a spring loaded mechanism for the engagement and disengagement of stem 25 that selectively causes stem 25 to be moved between a retracted position wherein it is concealed within tip 30 and an extended position, as illustrated in FIG. 1. Alternately, covert-print apparatus 300 may have a rotating tip mechanism for retracting stem 25. Retracting and rotating tip mechanisms are well known in the art.

Covert-print apparatus 300 may be designed to allow for the use of a variety of covers or caps 130, which may fit over the non-working end of casing 20. Cap 130 may have features, including but not limited to a discerning or decoding means 150 for the examination of covert prints in a marking made using covert-print apparatus 300. Discerning or decoding means 150 may be a magnifying means, UV means, or other means for revealing covert-print coding in a marking made using covert-print apparatus 300.

Figure 4:
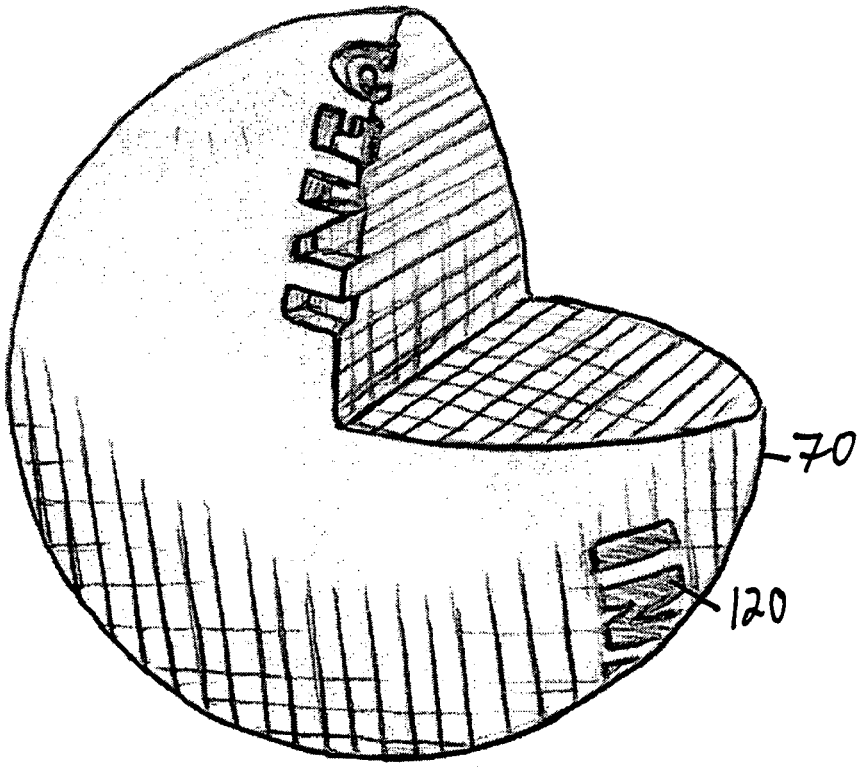
FIG. 4 is a magnified perspective view of the point of the covert-print apparatus shown in FIG. 1, shown in cross-section to illustrate depth.
Figure 5:
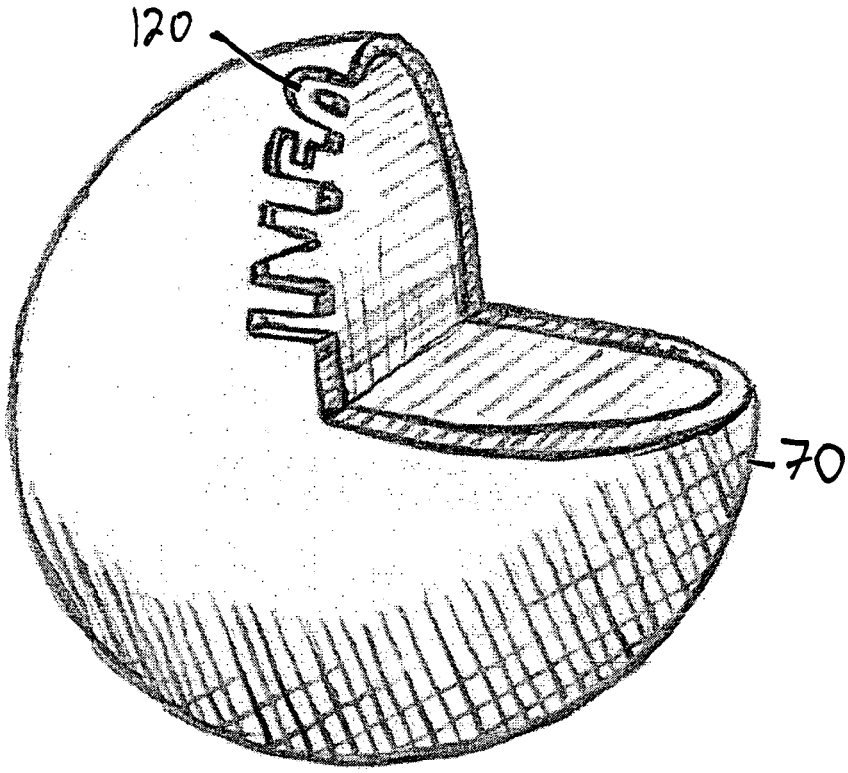
FIG. 5 is a magnified perspective view of a layered point of the covert-print apparatus shown in FIG. 1 shown in cross-section to illustrate depth.

Referring to FIGS. 3 through 5, point 70 is preferably spherical. Covert-print features 120 are disposed on the surface of point 70. Covert-print features 120 may be engraved into the surface of point 70, as shown in FIG. 3. Alternately, as shown in FIG. 5, covert-print features 120 may be layered onto point 70 or raised above the surface of point 70 (not shown). Covert-print feature 120 may simply be in the form of a magnetic pattern with no other special qualities. The point may be manufactured as one solid unit of all the same material or a mixture of materials FIG. 3, or may be comprised of multiple layers of different materials FIG. 5 or multiple layers of the same material FIG. 5. Covert-print features 120 may be symbols, numbers, letters, or any other recognizable characters or images or microprint, and may utilize ultraviolet, magnetism, or physical indentation to create said markings. Point 70 is housed in the end of stem 25 in such a way as to enable appropriate access to ink reservoir or source 100 while also protruding appropriately from stem 25 in such a way as to remain secure while making contact with a writing surface. In use, point 70 is in direct contact with the document or writing surface. As point 70 is drawn along the surface, ink is drawn onto point 70 from ink reservoir 100 and is transferred onto a writing surface, leaving a written ink line or mark. Within the written ink line or mark, point 70 also leaves a negative or positive, microphotographic, spectroscopic, ultraviolet, physical, optical, atomic, molecular, or magnetic image of the symbols, numbers, letters, or any other recognizable characters, images or markings engraved into, protruding from, or magnetically or chemically printed on point 70. The markings may appear in the form of magnetic differences in the ink pattern of the written line, which may include varying or alternating colored pigments. These markings may or may not be visible to the naked eye, ultraviolet or other light-dependent markings that may or may not be visible to the naked eye, or physical indentations that may or may not be visible to the naked eye. The markings may include a time-sensitive factor, such as but not limited to an encoded date or magnetized or chemically induced ink whose magnetic field or chemical composition weakens as time passes, thus limiting the period of time in which that particular covert-print apparatus' mark may be considered valid and providing additional security.

Point 70 may be a ball bearing, such as those found in conventional ballpoint pens, with the unique feature of being engraved with covert-print features 120. Point 70 may also be a differently shaped piece that is mounted on one or more axes and is capable of smoothly rolling along a surface, allowing free rotation preferably 360 degrees, while delivering a controlled ink marking to a writing surface. Covert-print features 120 are preferably engraved into point 70 and may vary in depth, height, width, internal volume, size, shape, font, and other characteristics. Covert-print features 120 may wrap around the surface of point 70, may appear more than once on point 70, and/or may appear in more than one direction or orientation on point 70. Point 70 may leave only an impression of covert-print features 120 and may otherwise leave a written ink line or mark that appears to be normal or typical to the naked eye.

Point 70 may be housed securely within stem 25 by means of fitting precisely into a portion of stem 25 molded and assembled for that purpose. Thus, point 70 may be attached by means of secure containment within stem 25. Stem 25 should allow enough space for movement of point 70, as well as the controlled flow of ink from ink reservoir 100 across point 70 and onto a writing surface. Stem 25 may have a spherical space comprised of curved parts, fitted together to enclose point 70, while allowing access to ink reservoir or source 100 on one side and access to the writing surface on the other.

To apply ink from a writing instrument to a substrate, point 70 is rotated by applying pressure to the substrate with the tip of the covert-print apparatus 300. As the working end of the covert-printing apparatus 300 is rolled across a substrate (or other writing surface), point 70 is rotated due to friction, and ink which clings to point 70 is drawn from ink reservoir 100 and transferred to the substrate. The invention dispenses covert-printed features 120 within the written ink line or mark as the point 70 rolls across the substrate (or other writing surface), applying ink in the conventional manner, with the following unique result: ink is not applied to areas of the substrate (or other writing surface) where point 70 has been engraved, leaving a negative image of the covert-printed features 120 engraved into point 70 of the instrument.

In an alternate embodiment of point 70, a positive imprint of covert-print features 120 may be left if point 70 is not engraved but, rather, is molded or otherwise formed to have protruding markings within the engraving, or both methods may be utilized simultaneously on a single point. In addition, chemical, magnetic, or physical indentation methods may or may not also be utilized singly or in combination with the previously described methods.

Ink employed in the current invention may vary considerably in color, chemical composition, volume, density, viscosity, magnetism, and other physical properties. The inks disclosed in U.S. Pat. Nos. 6,613,815, 6,528,557 and 5,958,121 are incorporated by reference herein. The ink or color source may be designed to be deliverable from within ink reservoir 100 or across the point 70 and onto the substrate or writing surface effectively in the conventional manner to create normal written ink line(s) or mark(s). However, the ink or color source must be chosen to have additional special properties. The ink or color source must cling to point 70 without in any way obscuring the unique covert-print features 120 on point 70. Additionally, upon being applied to a substrate or writing surface, the ink or color source must not spread or bleed such that the image left by covert-print features 120 on point 70 is in any way obscured, unless they are obscured intentionally. In general, the ink must support the unique result of leaving unique, legible or otherwise clear covert-print markings within the written ink line(s) or mark(s).

In an alternate embodiment, point 70 has covert-print features 120 that protrude from point 70, rather than simply being engraved or cut out of point 70. In this embodiment, ink must again be chosen for the properties cited above, namely, the ability to cling to point 70 without obscuring covert-print features 120, and the ability to be applied to a substrate without obscuring covert-print features 120. Ink may also be designed in such a way as to make covert-print features 120 appear either noticeably lighter or darker than the rest of the inked line(s), or be visually distinguishable only through the physical imprint of covert-print features 120 upon the paper. The ink or color source may only be visible under certain types of light, or by applying specially designed chemical agents, or by waiting a certain period of time for changes to occur in the ink or in a reaction of the ink with conventional or specially treated substrate which would then render the ink visible or detectable. The unique covert-print markings may be made by magnetically charged particles within specialized ink, drawn into a magnetized patterns, colors, symbols, numbers, letters or characters on the points' surface or into covert-print feature 120 by a precise magnetic charge in point 70, and may thus be visible with the naked eye or using a magnetic reading device. The markings may have an option of enhanced clarity of the covert-print through magnetically charged ink and components, or a process through which residual ink is removed from the engraved covert print by means of physical or magnetic displacement.

Figure 6:
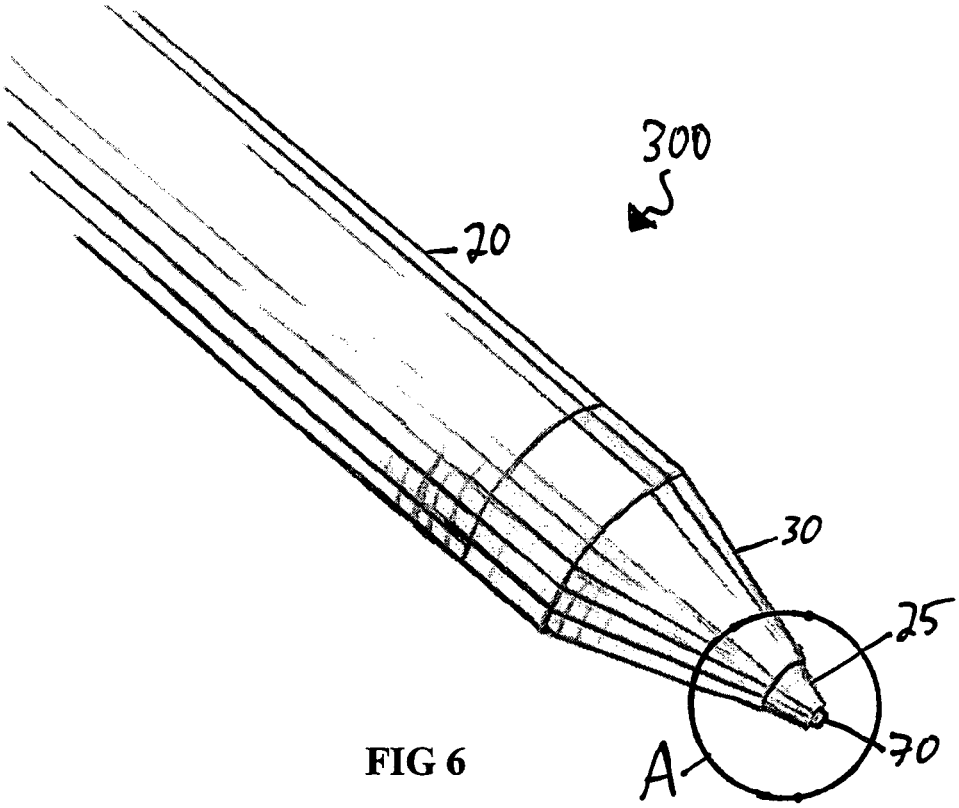
FIG. 6 is a perspective view of an alternate embodiment of the covert-print apparatus of the present invention having a non-spherical point.
Figure 7:
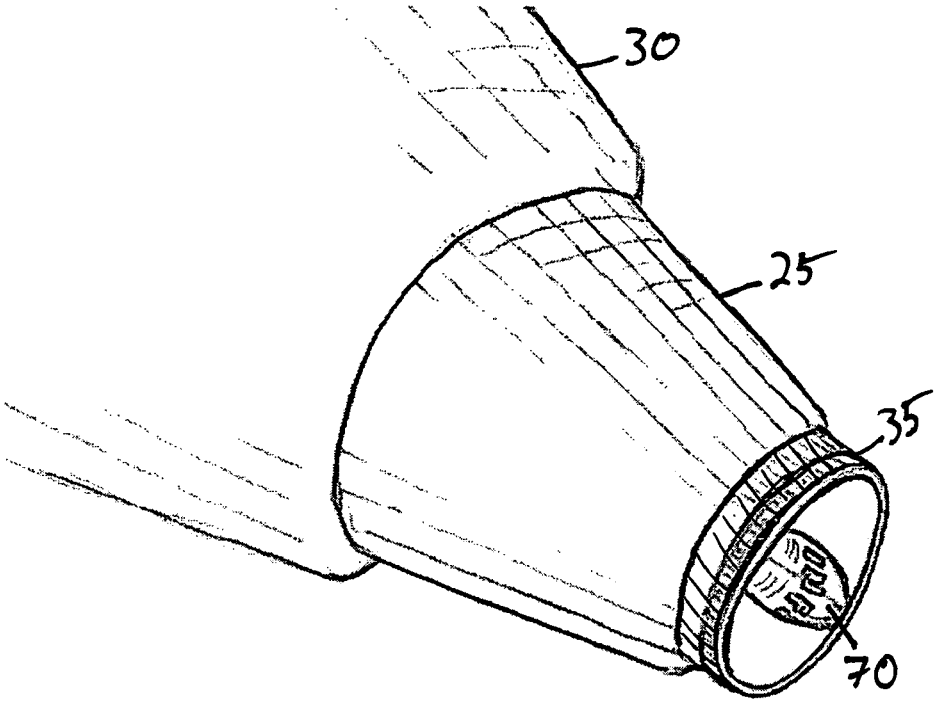
FIG. 7 is a magnified perspective view of the point of the covert-print apparatus of the present invention having a non-spherical point shown in window A of FIG. 6.
Figure 8:
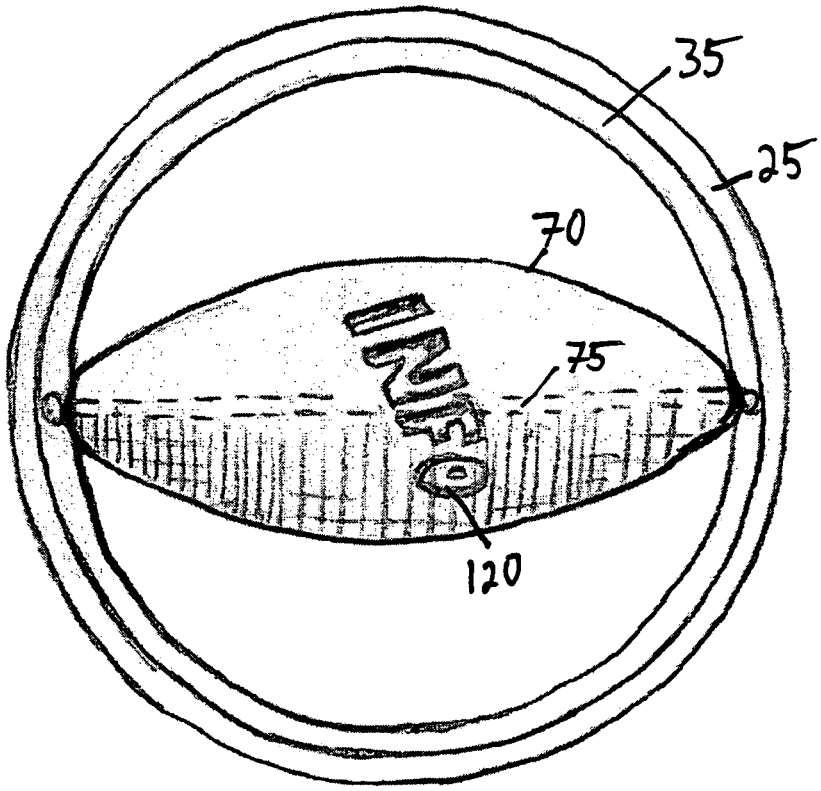
FIG. 8 is a magnified front view of the tip of the covert-print apparatus of the present invention shown in window A of FIG. 6.

In another alternate embodiment, point 70 may be a spherical or differently shaped piece, capable of smoothly rolling along a writing surface, as shown in FIGS. 6 and 8. In this embodiment, differently shaped point 70 is mounted on one or more axes, allowing it to rotate freely, preferably 360 degrees, while delivering a controlled ink marking to a writing surface. According to this embodiment, point 70 may be a sphere, oval, or other piece capable of rolling and spinning about a central axis 75 running through a middle of point 70. The central axis 75 of point 70 may be a small pin or similar means. The pin is attached to a ring shaped piece 35 which is securely contained by stem 25, while leaving sufficient room for rotation of the ring, to allow maximum rotation of point 70, preferably in 360 degrees.

The present invention also provides a method for authenticating a written document as being unique to a particular marking apparatus. Covert-print apparatus 300 provides an efficient and logical form of document security, assuring the recipient of a written document that the origin of a document is authentic. Covert-print features provide a means for a knowing recipient to verify the origin, authorship, and/or content of any text by verifying that it was written by the possessor of a particular instrument.

Writing may be verified as authentic based on several characteristics. Preferably, verification is not based solely on covert-printed code being discernable within every portion of a questionable written ink line or mark. For example, should a signature's authenticity require confirmation, the written ink line or mark will have a majority of the surface encoded with covert print in order to qualify as authentic. It must be taken into account that writing of different letters, characters, numbers and symbols have varying amounts of overlapping within a written line or single symbol or character. In these instances, the presence of covert-printed code within the area of the character or characters that typically overlaps will not be considered as critical part to the authentication process, because the overlapping areas will likely have less distinguishable covert print than an area of the line not overlapping. During the verification process an additional security step may be employed by analyzing the position and/or angle of covert-print features 120 of point 70. A questionable covert-printed ink line may now be compared with expected values based on the position and/or angle layout of the authentic covert-print record.

Additionally, if several samples of the authorized owner's writing are taken (signatures, etc.) using the covert-print apparatus as the means of writing, then OCR software or a method by which the written ink line or mark is verified may be refined by giving the areas of the text that overlap in the sample(s) less emphasis than other areas not overlapping when comparing the questionable text with the sample text. Workers skilled in the art will recognize that changes may be made in form and detail of this process. Further, it is not desired to limit the invention to the exact process and method described, and accordingly, all suitable other methods and processes of the authentication process will become obvious to the reader and it is intended that these methods and processes are within the scope of the present invention.

The invention can best be manufactured by introducing an additional step or steps to the known processes for manufacturing a conventional ballpoint pen, wherein point 70 of covert-print apparatus 300 is engraved with unique covert-print features 120. The engraving may be accomplished by means including, but not limited to, use of a laser, diamond-tipped or other highly dense cutting tools, or, alternatively, by molding point 70 with covert-print features 120 already embedded in the mold. Alternatively, precision magnetizing of point 70 may be used, or the point 70 may be created using already magnetized particulates that are then molded appropriately to form covert-print pattern 120 when point 70 is utilized or a smooth spherical point for use with non-engraved magnetization only verification. Point 70 may or may not be magnetically charged and may or may not have a physical engraving.

Covert-print apparatus 300 leaves unique markings within the written ink line or mark itself, thereby identifying the specific instrument used to compose the line or mark. If each covert-print apparatus 300 is manufactured with its own unique covert-print features 120 engraved or magnetized into point 70, anything written with that specific covert-print apparatus 300 leaves covert-print features 120 within the written ink lines or marks. This allows a recipient to verify the authenticity of a document written with covert-print apparatus 300. (This is contingent on the instrument being assigned to and in the possession of the authorized signatory at the time of use). Additionally, any written content contained in the document may be verified in the same manner, considerably limiting any possibility of fraud or deception.

In practice, point 70 of covert-print apparatus 300 rolls over a writing surface, leaving a written line. Within the written ink line or mark, point 70 leaves features 120 (in the standard variation, covert-print negatives of the engraving), which may or may not be too small to see or notice upon casual observation of the writing with the naked eye, identifying the specific instrument that was used to write. Features 120 can be seen by examining the writing with a magnifying glass, or possibly closely with a very healthy naked eye. However, features 120 may be designed such that they cannot be copied by conventional photocopiers, or by any other method, without the original covert-print apparatus 300. These unique markings assure the recipient of a document that it was written by a particular covert-print apparatus 300, and is not forged or reproduced.

Covert-print apparatus 300 provides a means for heightening document security. A creator may examine writing made using the covert-print apparatus 300 for the presence of unique covert-print features 120. The features 120 may or may not be visible with close scrutiny by the healthy naked eye, or by means of a magnifying glass (which may or may not be attached to covert-print apparatus 300), or by means of electronic character recognition, or optical character recognition, or by means of a chemical test, or magnetic reading device, or any of these used singly or in any combination. Covert-print features 120 could be stored in a physical or electronic database that could be made available to consumers, corporations, organizations and/or governing bodies, or these entities may store their own databases, for the purposes of verifying a document's content containing individually assigned unique markings. This verification procedure may be used to authenticate the writing and signatures contained in official documents or contracts, including but not limited to currency, bonds, stocks, securities, travelers checks, bank checks, credit cards, credit cards receipts, passports, airline tickets, labels, green cards, prescription slips, tests and examinations, police or witness reports, affidavits, research documents, legal waivers and releases, and any other business, personal, legal and/or government document in which identification of the creator or signatory is critical. It may also be used in many unofficial applications, including but not limited to personal correspondence, journaling for posterity, archiving and scrap booking, writing for publication, autographing, or a variety of other unofficial purposes. In addition, the covert-print may be used to prove date of authorship in any case in which the time of writing is an important factor, including but not limited to patent applications, checks, affidavits, and any other legally binding or non-legally binding documents. Additionally, covert-print apparatus 300 may be used simply for entertainment of its novel features.

An example of use of the covert-print apparatus 300 as a security means is now described. A ballpoint-type covert-print apparatus 300 has a point 70 that is engraved "JOHNSMITH01". This covert-print apparatus 300 is reserved for John Smith. No other person can then order a covert-print apparatus 300 that leaves the mark "JOHNSMITH01". John Smith now brings his writing instrument to his local bank and signs a new signature card, and within the ink lines of his signature appears the unique negative image(s) of the characters "JOHNSMITH01" repeating several times in a random configuration. Now any forged checks can be rejected, even if the signature is very similar, because the bank clerk may now verify the security markings on the check left by the unique covert-print apparatus 300. The bank clerk or optical character recognition and verification mechanism (O.C.R.), as described in U.S. Pat. No. 6,373,573 and incorporated herein by reference may simply view John Smith's signature card, or access the bank's electronic database; or a global covert-print apparatus signatory database, and then examine the questionable check or document for the matching "JOHNSMITH01" covert-print feature. Additionally, the amounts and other handwritten fields on the check can be verified in the same manner. Thus, the authenticity of the check's signature and/or other fields' content can by verified or disproved and a potential forgery or unauthorized check modifications can be averted.

Figure 12:
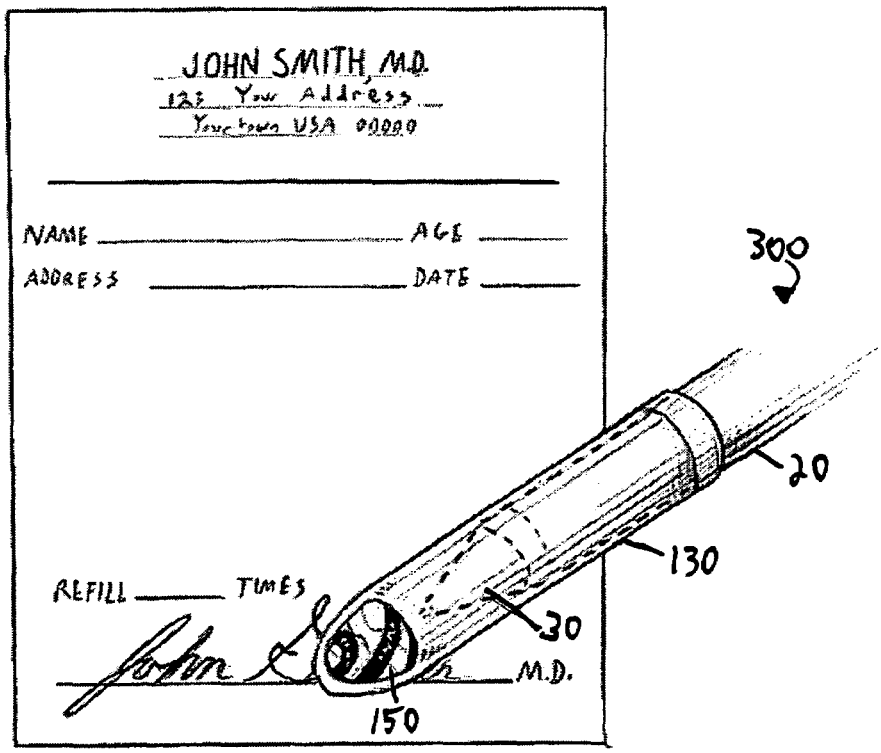
FIG. 12 is a side perspective view of the magnifying cap of the covert-print apparatus of the present invention in use with a doctor's prescription pad.

A second example employing covert-print apparatus 300 as a security device is shown in FIG. 12. In this example, a medical prescription written by a doctor could be verified by the pharmacy using that physician's covert-print signature card, or by accessing their own or a globally maintained physical or electronic database of physician signatures with covert-print 120 feature. This application could not only reduce costs associated with fraud, reduce illegal sale and distribution of prescription drugs, and save millions of people's wasted time and energy associated with calling in highly restricted prescriptions or revisiting physicians' offices, but it could also potentially save lives. By allowing quick and easy verification of prescriptions, dangerous delays in receiving vital drugs can be avoided for the millions of people who depend on prescriptions to live. In addition, potentially harmful self-medicating, recreational use, and other abuses of prescription drugs can be avoided by significantly reducing prescription fraud.

Although the present invention has been described with reference to preferred embodiments, workers skilled in the art will recognize that changes may be made in form and detail without departing from the spirit and scope of the invention.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the graphic and described in the specification are intended to be encompassed by the present invention.

The present invention—in its written aspect or in the covert-print feature itself—may include, among other things, variations that are microphotographic, spectroscopic, optical, magnetic, atomic, molecular, or biological (as in the case of DNA), in any combination or used singularly, all of which may be used as verification means.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A marking apparatus for creating a unique mark, comprising:

a housing having a working end;

marking means situated at said working end of said housing and movable relative to a substrate for selectively producing a first marking on a surface of the substrate along the path of movement along the substrate;

covert-printing means on said marking means disposed on said working end of said housing for applying a unique second marking, normally not discernable to the naked eye, substantially superimposed and coextensive with said first marking, whereby a determination of said second marking uniquely identifies the marking apparatus utilized in creating said first and second markings, said covert-printing means comprising means for applying any combination of one or more markings selected from the group consisting of symbols, letters, numbers or any other distinguishable marking.

2. A marking apparatus for creating a unique mark, comprising:

a housing having a working end;

marking means situated at said working end of said housing and movable relative to a substrate for selectively producing a first marking on a surface of the substrate along the path of movement along the substrate;

covert-printing means on said marking means disposed on said working end of said housing for applying a unique second marking, normally not discernable to the naked eye, substantially superimposed and coextensive with said first marking, whereby a determination of said second marking uniquely identifies the marking apparatus utilized in creating said first and second markings, said marking means including a source of ink or other marking means inserted into said casing by means of an opening disposed in a non-working end of said housing.

3. A marking apparatus for creating a unique mark, comprising:

a housing having a working end;

marking means situated at said working end of said housing and movable relative to a substrate for selectively producing a first marking on a surface of the substrate along the path of movement along the substrate;

covert-printing means on said marking means disposed on said working end of said housing for applying a unique second marking, normally not discernable to the naked eye, substantially superimposed and coextensive with said first marking, whereby a determination of said second marking uniquely identifies the marking apparatus utilized in creating said first and second markings, further comprising a retraction mechanism for retracting said covert-printing means.

4. A marking apparatus for creating a unique mark, comprising:

a housing having a working end;

marking means situated at said working end of said housing and movable relative to a substrate for selectively producing a first marking on a surface of the substrate along the path of movement along the substrate;

covert-printing means on said marking means disposed on said working end of said housing for applying a unique second marking, normally not discernable to the naked eye, substantially superimposed and coextensive with said first marking, whereby a determination of said second marking uniquely identifies the marking apparatus utilized in creating said first and second markings, said covert-printing means comprising at least one of physical, optical, magnetic, atomic, molecular or biological variables, forming at least one of the following selected from the group of:

a covert-print detectable without any special equipment;

a covert-print visible or detectable with a reader;

a covert-print visible or detectable with an energy source; and a covert-print containing encoded information that can be detected by a decoder.

5. A marking apparatus for creating a unique mark, comprising:

a housing having a working end;

marking means situated at said working end of said housing and movable relative to a substrate for selectively producing a first marking on a surface of the substrate along the path of movement along the substrate;

covert-printing means on said marking means disposed on said working end of said housing for applying a unique second marking, normally not discernable to the naked eye, substantially superimposed and coextensive with said first marking, whereby a determination of said second marking uniquely identifies the marking apparatus utilized in creating said first and second markings, said covert-printing means including a movable member arranged to rotate when moved along the surface of the substrate.

6. The marking apparatus of claim 5, wherein said covert-printing means is raised above an outer surface of said movable member.

7. The marking apparatus of claim 5, wherein said covert-printing means is engraved into an outer surface of said movable member.

8. The marking apparatus of claim 5, wherein said working end is in the form of a tip housing said movable member.

9. The marking apparatus of claim 8, wherein said tip is coupled to said housing by a means selected from the group consisting of threading, snapping, fitting and adhesive connection.

10. The marking apparatus of claim 8, wherein said tip is a conical structure.

11. The marking apparatus of claim 8, wherein said tip is shaped to fit said point securely therein.

12. The marking apparatus of claim 5, wherein said movable member is spherical.

13. The marking apparatus of claim 5, wherein said movable member is non-spherical and rotates about an axis.

14. The marking apparatus of claim 5, wherein said marking means includes a source of ink or other marking means inserted within a space within said housing created by separating a first half of said housing from a second half of said housing.

15. The marking apparatus of claim 5, further comprising a cap having a discerning means disposed therein.

16. The marking apparatus of claim 15, wherein said discerning means includes inspecting means for inspecting said writing for markings formed by said unique covert-printing means.

* * * * *